US006210516B1

(12) United States Patent
Nohr et al.

(10) Patent No.: US 6,210,516 B1
(45) Date of Patent: Apr. 3, 2001

(54) PROCESS OF ENHANCED CHEMICAL BONDING BY ELECTRON SEAM RADIATION

(76) Inventors: Ronald Sinclair Nohr, 452 Bellflower Ct., Roswell, GA (US) 30076; John Gavin MacDonald, 1472 Knollwood Ter., Decatur, GA (US) 30033

( * ) Notice: Subject to any disclaimer, the term of this patent is extended or adjusted under 35 U.S.C. 154(b) by 0 days.

(21) Appl. No.: 08/944,258

(22) Filed: Oct. 6, 1997

Related U.S. Application Data

(63) Continuation of application No. 08/548,398, filed on Oct. 26, 1995, now abandoned, which is a continuation of application No. 08/198,935, filed on Feb. 22, 1994, now abandoned.

(51) Int. Cl.[7] ..... B32B 3/00

(52) U.S. Cl. ..... 156/272.2; 156/275.5; 250/400; 250/492.3

(58) Field of Search ..... 156/272.2, 275.5; 250/492.3, 400

(56) References Cited

U.S. PATENT DOCUMENTS

| | | | |
|---|---|---|---|
| 2,384,778 | 9/1945 | Whitman | 250/43 |
| 2,602,751 | 7/1952 | Robinson | 99/221 |

(List continued on next page.)

FOREIGN PATENT DOCUMENTS

| | | | |
|---|---|---|---|
| 651 687 | 11/1962 | (CA) | 204/92.4 |
| 2 105 019 | 8/1971 | (DE) | D06M/11/04 |
| 31 05511A1 | 9/1982 | (DE) . | |
| 52 28684 | 3/1977 | (JP) . | |
| 53 105579 | 9/1978 | (JP) . | |
| 54 110275 | 8/1979 | (JP) . | |

OTHER PUBLICATIONS

TPI Textil Praxis International, vol. 44, No. 12, Dec. 1989, Leinfelden–Echterdingen, DE, pp. 1312–1316, XP000113823 Dr. U. Einsele: "Elektronenstrahlinduzierte Polymerisationsreaktionen in der Textilveredlung/6.Mitteilung: Modifizierung von PP–Fasern" pp. 1313–1314, No. 3, Aufpfropfen von Acrylsaure.

European Search Report for EP 95 101 235.0 dated Aug. 26, 1996.

Abstract for German Patent 2 105 019.

English translation of Article A1 entitled "Electron–Beam Induced Polymerization Reactions in Textile Finishing".

I.J. Rangwalla, K.E. Williams & S.V. Nablo: "The Design and Performance of Self–Shielded Electron Processors for Filament, Wire and Tubing Applications": Nuclear Instruments and Methods in Physics Research B40/41 (1989) 1146–1152.

Y.C. Ko, B.D. Ratner and A.S. Hoffman: "Characterization of Hydrophilic—Hydrophobic Polymeric Surfaces by Contact Angle Measurements": Journal of Colloid and Interface Science, vol. 82, No. 1 (1981) 25–37.

(List continued on next page.)

*Primary Examiner*—Jenna Davis

(57) ABSTRACT

Permanent surface modification of polypropylene nonwoven fabrics is achieved through electron beam radiation induced chemical bonding. The electron beam energy levels suitable for such chemical bonding are between about 5 KeV to about 110 KeV at the surface of the fabric facing the electron beam radiation source. At these energy levels, chemical bonding, control of electron beam penetration and the formation of free radicals in the polypropylene nonwoven fabrics are achieved. Control of electron beam penetration produces free radical formation and chemical bonding at selective levels within the fabric as well as bonding of different chemicals asymmetrically to the same fabric with minimal, if any, loss of polymer fabric strength.

11 Claims, 3 Drawing Sheets

U.S. PATENT DOCUMENTS

| | | | |
|---|---|---|---|
| 2,855,517 | 10/1958 | Rainer et al. | 250/51 |
| 2,956,899 | 10/1960 | Cline | 117/47 |
| 2,999,056 | 9/1961 | Tanner | 204/154 |
| 3,013,154 | 12/1961 | Trump | 250/49.5 |
| 3,252,880 | 5/1966 | Magat et al. | 204/154 |
| 3,281,263 | 10/1966 | Priesing et al. | 117/62 |
| 3,372,100 | 5/1968 | Charlesby et al. | 204/159.17 |
| 3,440,466 | 4/1969 | Colvin et al. | 313/35 |
| 3,440,566 | 4/1969 | Swanson | 332/9 |
| 3,448,182 | 6/1969 | Derbyshire et al. | 264/22 |
| 3,455,337 | 7/1969 | Cook | 138/178 |
| 3,588,565 | 6/1971 | Trump | 313/74 |
| 3,617,740 | 11/1971 | Skillicorn | 250/49.5 |
| 3,654,459 | 4/1972 | Coleman | 250/49.5 |
| 3,660,217 | 5/1972 | Kehr et al. | 161/68 |
| 3,702,412 | 11/1972 | Quintal | 313/299 |
| 3,709,718 | 1/1973 | Schamberg et al. | 117/93.31 |
| 3,725,230 | 4/1973 | Bahder et al. | 204/159.2 |
| 3,745,396 | 7/1973 | Quintal et al. | 313/37 |
| 3,749,967 | 7/1973 | Douglas-Hamilton et al. | 315/85 |
| 3,769,060 | 10/1973 | Ida et al. | 117/37 R |
| 3,769,600 | 10/1973 | Denholm et al. | 328/233 |
| 3,780,308 | 12/1973 | Nablo | 250/492 |
| 3,864,570 | 2/1975 | Zingaro | 250/272 |
| 3,872,351 | 3/1975 | Smith et al. | 315/107 |
| 3,924,023 | 12/1975 | Boranian et al. | 427/54 |
| 3,939,049 | 2/1976 | Ratner et al. | 204/159.13 |
| 4,001,462 | 1/1977 | Blin et al. | 427/44 |
| 4,041,192 | 8/1977 | Heger et al. | 427/43 |
| 4,049,757 | 9/1977 | Kammel et al. | 264/22 |
| 4,099,969 | 7/1978 | Leder | 96/1.5 R |
| 4,100,311 | 7/1978 | Nablo et al. | 427/44 |
| 4,100,318 | 7/1978 | McCann et al. | 428/159 |
| 4,100,450 | 7/1978 | Frutiger et al. | 313/360 |
| 4,101,699 | 7/1978 | Stine et al. | 428/36 |
| 4,107,390 | 8/1978 | Gorden et al. | 428/447 |
| 4,108,736 | 8/1978 | Rigo et al. | 204/1.5 |
| 4,133,939 | 1/1979 | Bokerman et al. | 428/447 |
| 4,148,839 | 4/1979 | Fydelor | 260/857 |
| 4,160,188 | 7/1979 | Butterwick | 313/446 |
| 4,178,509 | 12/1979 | More et al. | 250/374 |
| 4,179,401 | 12/1979 | Garnett et al. | 252/426 R |
| 4,198,200 | 4/1980 | Fonda et al. | 431/360 |
| 4,211,622 | 7/1980 | Nablo | 204/159.12 |
| 4,214,187 | 7/1980 | Mourier | 315/111.8 |
| 4,246,297 | 1/1981 | Nablo et al. | 427/44 |
| 4,252,413 | 2/1981 | Nablo | 250/310 |
| 4,264,644 | 4/1981 | Schaetti | 427/55 |
| 4,288,499 | 9/1981 | Kielbani, Jr. | 428/518 |
| 4,303,296 | 12/1981 | Chitouras | 427/44 |
| 4,303,695 | 12/1981 | McCann et al. | 427/44 |
| 4,305,000 | 12/1981 | Cheever | 250/492.3 |
| 4,324,854 | 4/1982 | Beauchamp et al. | 430/296 |
| 4,330,493 | 5/1982 | Miyamoto et al. | 264/22 |
| 4,346,142 | 8/1982 | Lezear | 428/315.7 |
| 4,367,412 | 1/1983 | Cheever | 250/492.3 |
| 4,382,186 | 5/1983 | Denholm et al. | 250/492.2 |
| 4,393,311 | 7/1983 | Feldman et al. | 25/459.1 |
| 4,409,511 | 10/1983 | Loda et al. | 313/34 |
| 4,424,240 | 1/1984 | Kielbania, Jr. | 427/393.5 |
| 4,439,686 | 3/1984 | Cheever | 250/492.3 |
| 4,446,373 | 5/1984 | Denholm et al. | 250/492.2 |
| 4,452,679 | 6/1984 | Dunn et al. | 204/164 |
| 4,452,827 | 6/1984 | Kolev et al. | 427/38 |
| 4,481,244 | 11/1984 | Haruta et al. | 428/155 |
| 4,490,409 | 12/1984 | Nablo | 427/44 |
| 4,491,616 | 1/1985 | Schmidle et al. | 428/458 |
| 4,492,718 | 1/1985 | Mayer et al. | 427/160 |
| 4,495,250 | 1/1985 | Itagaki et al. | 428/520 |
| 4,496,881 | 1/1985 | Cheever | 315/357 |
| 4,507,342 | 3/1985 | Kielbania, Jr. | 428/90 |
| 4,521,445 | 6/1985 | Nablo et al. | 427/44 |
| 4,525,374 | 6/1985 | Vaillancourt | 427/2 |
| 4,526,673 | 7/1985 | Little et al. | 204/192 |
| 4,527,044 | 7/1985 | Bruel et al. | 219/121 |
| 4,533,566 | 8/1985 | Evans et al. | 427/44 |
| 4,537,811 | 8/1985 | Nablo | 428/166 |
| 4,544,580 | 10/1985 | Haruta et al. | 427/261 |
| 4,563,507 | 1/1986 | Dyer | 525/426 |
| 4,565,857 | 1/1986 | Grant | 527/301 |
| 4,571,316 | 2/1986 | Naruse et al. | 264/22 |
| 4,606,870 | 8/1986 | McGregor | 264/22 |
| 4,610,956 | 9/1986 | Fuchizawa et al. | 430/538 |
| 4,652,763 | 3/1987 | Nablo | 250/492.3 |
| 4,803,126 | 2/1989 | Wyman | 428/447 |
| 4,861,407 | 8/1989 | Volkmann et al. | 156/272.8 |
| 4,861,408 | 8/1989 | Kelber | 156/273.3 |
| 4,865,892 | 9/1989 | Winfield et al. | 428/34.9 |
| 4,879,148 | 11/1989 | Neaves et al. | 428/40 |
| 4,886,681 | 12/1989 | Clabes et al. | 427/38 |
| 4,897,433 | 1/1990 | Sugo et al. | 422/116 |
| 4,944,879 | 7/1990 | Steuck | 210/500.27 |
| 4,950,546 | 8/1990 | Dubrow et al. | 428/447 |
| 5,011,867 | 4/1991 | Mallya et al. | 522/109 |
| 5,028,683 | 7/1991 | Martens et al. | 528/75 |
| 5,126,199 | 6/1992 | Sawyer et al. | 428/359 |
| 5,135,598 * | 8/1992 | Kobe et al. | 156/275.5 |
| 5,160,464 | 11/1992 | Ward et al. | 264/22 |
| 5,414,267 * | 5/1995 | Wakalopulos . | |

OTHER PUBLICATIONS

Gregor, E.C. & Tanny, G., "Nonwovens Converted Into Microporous Barriers", Nonwovens Industry, Oct. 1985, pp. 58–60.

Abstract for J53–105579, Furukawa Electric Co. 9/13/78.

Abstract for J54–110275, Sumitomo Elec. Ind. K.K. 8/29/79.

Abstract for J52–28684, Furukawa Denki Kogyo K.K. 3/3/77.

Abstract for 31 05511A1, Siemens AG, 9/2/82.

* cited by examiner

PROCESS OF ENHANCED CHEMICAL BONDING BY ELECTRON SEAM RADIATION

This application is a continuation of application Ser. No. 08/548,398 entitled "PROCESS OF ENHANCED CHEMICAL BONDING BY ELECTRON BEAM RADIATION" and filed in the U.S. Patent and Trademark Office on Oct. 26, 1995, now abandoned, which is a continuation of application Ser. No. 08/198,935 entitled "PROCESS OF ENHANCED CHEMICAL BONDING BY ELECTRON BEAM RADIATION" and filed in the U.S. Patent and Trademark Office on Feb. 22, 1994, now abandoned. The entirety of this application is hereby incorporated by reference.

FIELD OF THE INVENTION

This invention relates to processes of chemically bonding materials to polymers by radiation. More particularly, this invention relates to improved techniques of chemical bonding by electron beam radiation.

BACKGROUND OF THE INVENTION

Generally, polymer materials and materials formed from polymers are sometimes classified in one of two groups, i.e., hydrophilic or hydrophobic, based upon the polymer surface affinity for water. If the polymer is water wettable or the polymer absorbs water or in someway unites with or takes up water, then the polymer is considered "hydrophilic". If the polymer is not water wettable or repels water or in someway does not unite with or absorb water, then the polymer is considered "hydrophobic".

While the water affinity property of a polymer is an important factor when determining the usefulness or applicability of a particular polymer in the formation of a product from such polymer, other factors, such as, but not limited to, costs, availability, polymer synthesis, environmental concerns, ease of handling, and current product composition are also weighed. In some instances, it may be more feasible to employ a water repellant or hydrophobic polymer in a product designed to absorb water than to use a water absorbent or hydrophilic polymer. In other instances it may be more feasible to employ a water absorbent or hydrophilic polymer in a product designed to repel water than to use a water repellant or hydrophobic polymer. In these instances, the selected polymer or polymer surface must be modified to conform to the intended use of the polymer in the ultimate product.

Historically, the surfaces of polymer compositions have been modified by non-permanent and permanent means. In the case of polymer compositions having hydrophobic surfaces, such non-permanent means include treating the polymer composition with surface active agents or surfactants. The surfactant, in combination with a hydrophilic composition, transforms the hydrophobic surfaces of the polymer composition to hydrophilic surfaces. However, in some instances, these modified hydrophilic surfaces generally became altered or lose their hydrophilic properties upon the first water wetting.

Permanent means of modifying polymer compositions include a number of wet chemical techniques and radiation techniques which initiate a chemical reaction between the polymer and a water affinity altering material. The process of chemical bonding by radiation is sometimes referred to as "grafting".

To permanently modify the polymer a chemical bond is formed between the polymer and the water affinity modifying material. Once chemically bonded to the polymer, the modifying material generally survives a first wetting so that the presence of the modifying material in the polymer alters the water affinity properties of the polymer for an extended period of time.

Wet chemical techniques include, but are not limited to, oxidation, acid or alkali treatments, halogenation and silicon derivative treatments. Radiation techniques which produce free radicals in the polymer include, but are not limited to, plasma or glow discharge, ultraviolet radiation, electron beam, beta particles, gamma rays, x-rays, neutrons and heavy charged particles.

There are generally three main techniques of forming chemical bonds between a polymer and a modifying material by radiation. These are: mutual; pre-radiation; and peroxide formation.

The mutual technique involves radiation of the polymer in the presence of a modifying material, wherein the modifying material is in either a liquid or vapor phase. The pre-radiation method involves radiating the polymer alone and then bringing the radiated polymer in contact with a modifying material, wherein the modifying material is in either a liquid or vapor phase. The peroxide formation method involves radiating the polymer in air and later decomposing the resulting polymeric peroxides in the presence of a modifying material, wherein the modifying material is in either a liquid or vapor phase. Both the mutual and the peroxide methods lead to homopolymerization, whereas the pre-radiation method leads mainly to copolymerization, i.e., chemical bonding occurring mainly between the polymer and the modifying material.

Generally, the mechanism by which a modifying material, and particularly a modifying material having a vinyl moiety, chemically bonds to the polymer upon radiation is via a free radical reaction between the polymer and the modifying material. Radiation produces free radicals in the polymer. The chemical bonding occurs in the polymer at the site of the formed free radical(s) and between the free radical(s) and the modifying material, and particularly between the free radical (s) and the modifying material's vinyl moiety.

Many of these radiation techniques have reaction times in minutes to hours to days. For example, ultraviolet radiation reactions using photoactivators have reaction times in the seconds to minutes range. Gamma radiation results in reaction times in the hours to days range. Additionally, many of these radiation techniques and wet chemical techniques may be relatively expensive and/or present environmental concerns.

In the case of on-line processing with web through-puts of between 600 to 1500 ft/min, rapid reaction rates are desirable. Therefore, there is a need to form chemical bonds with the polymer, such as on the surface of the polymer, in relatively short periods of time, generally less than 1/100 of a second, wherein the formation of such chemical bonds is economical, environmentally friendly and wherein the resulting bonds are sufficiently strong to survive multiple wettings.

To form chemical bonds under these requirements a sufficient dose of energy must be delivered to the polymer in less than 1/100 of a second. Of the above mentioned techniques, electron beam radiation affords the best opportunity to meet the rapid reaction times required by such on-line processing.

However, traditional on-line polymer processing via electron beam radiation at conventional energy levels of between 150 KV to 300 KV, producing electron energies greater than 145 KeV at the surface of the target polymer, has shown loss of polymer strength. Additionally, conventional electron beam radiation techniques, whether on-line or static, do not provide an ability to control the rate and location of the chemical bonding on the polymer. Furthermore, such conventional electron beam techniques deposit a large portion of the electron energy produced at these levels in the equipment shielding and not in the target polymer. Thus there exists a need to form chemical bonds by radiation, and particularly electron beam radiation, which avoids the above disadvantages.

SUMMARY OF THE INVENTION

In response to the above problems encountered by those of skill in the art, the present invention provides modified polymeric compositions and methods of effecting the polymeric modification by, for example, exposing the polymeric composition to radiation. For example, electron beam ionizing radiation wherein the polymeric composition is subjected to electron beam ionizing radiation in the range of from about 5 KeV to about 110 KeV. For example, from about 5 KeV to about 75 KeV of electron beam ionizing radiation. More particularly, from about 5 KeV to about 50 KeV of electron beam ionizing radiation. Even more particularly, from about 5 KeV to about 25 KeV of electron beam ionizing radiation.

Typically, the polymeric composition to be modified will be in a form possessing one or more surfaces. In one embodiment, the modification of the polymeric composition may affect the molecular structure of the molecules of the composition present on one or more of the composition's surfaces. For example, one or more modifying material(s) may be chemically joined or bonded to one or more of the compositions's surfaces. In some embodiments the degree of the modification may vary from surface to surface. That is, in embodiments where only one modifying material is present, a larger amount of the modifying material may be joined to one surface than another surface.

In other embodiments, the modification of the polymeric composition may affect the molecular structure of the molecules of the composition present in the interior of the composition. Additionally, in some embodiments the modification of the polymeric composition may affect the molecular structure of the molecules of the composition present at both the surface of the composition and in the interior of the composition. For example, the modification may be such that the degree of modification by the modifying material varies from the surface of the composition into the interior of the composition. Thus, a concentration gradient of the modifying material with respect to the distance from a surface of the composition may be created.

The present invention is also directed toward methods for effecting the modifications discussed above. These methods may include, for example the steps of bringing a modifying material into contact with a polymeric composition to be modified and radiating the polymeric composition with, for example, ionizing radiation such as electron beam radiation. Typically, the ionizing radiation source will be sufficient to apply from about 5 KeV to about 110 KeV of energy to the surface of the polymeric composition. The ionizing radiation is applied for a time sufficient to chemically bond or join the modifying material to the polymeric composition in the manner and location desired.

Exemplary polymeric compositions which may be modified in accordance with the teachings of the present invention include polyolefins such as polypropylene, polyethylene, polybutylene and copolymers.

Exemplary modifying materials include vinyl monomers, such as 4-fluoro-alpha-phenylstyrene, maleic acid and 2-hydroxyethylmethacrylate (HEMA), methacylates, alkenes and substituted alkenes.

DETAILED DESCRIPTION OF THE INVENTION

Generally, there are two different types of commercial electron beam processors. The first type of electron beam processor generates a narrow or pencil shaped beam of electrons. The narrow beam of electrons is scanned by an electromagnetic field over a width of the target.

The second type of electron beam processor generates a curtain of electrons over the entire target width. This type of electron beam processor eliminates the need to scan the beam over the width of the target. As such, the second type of electron beam processor provides better beam efficiency than the narrow beam processors of the first type. Increased beam efficiency provides for improved continuous and uniform treatment of the target.

Figure 1:
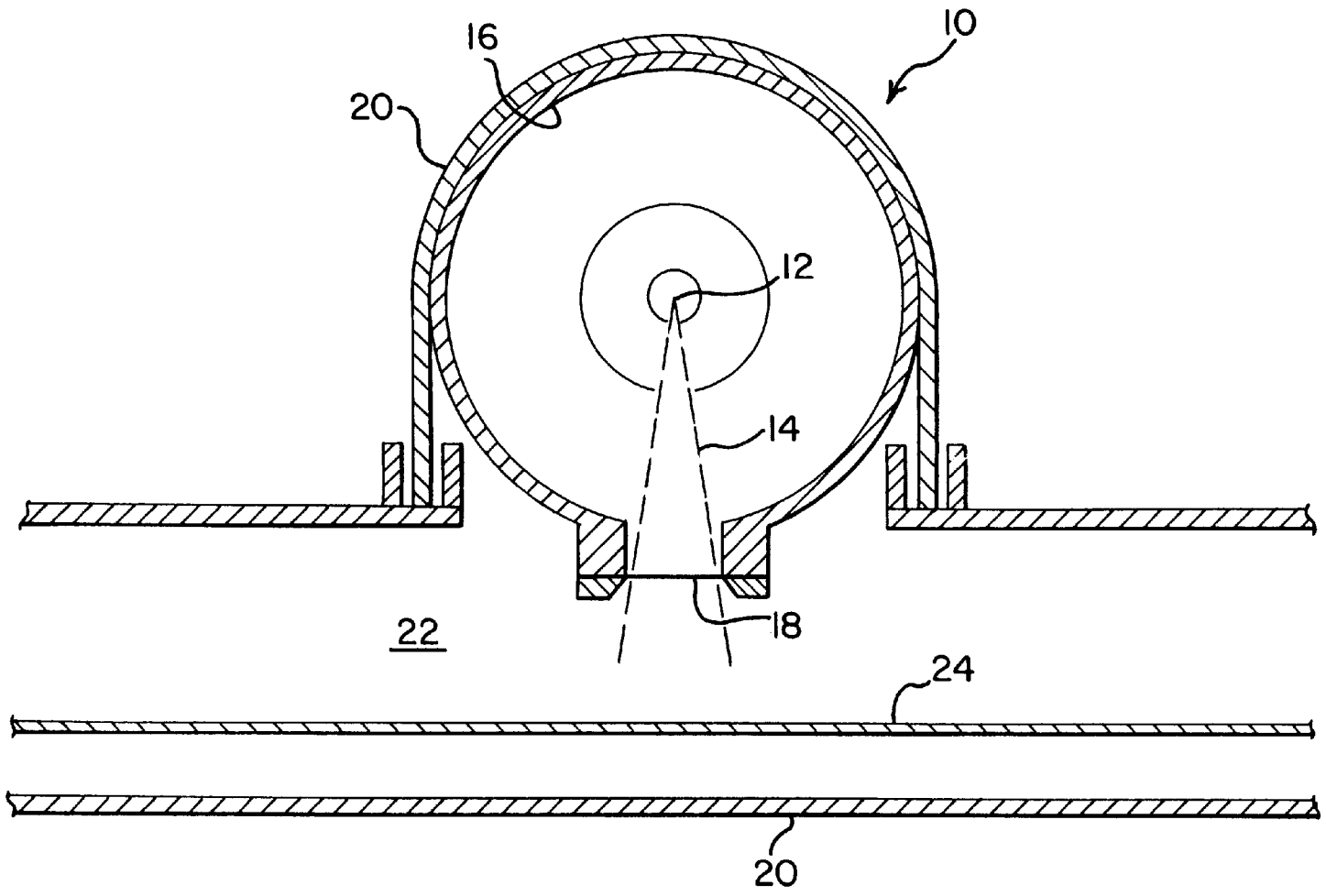
FIG. 1 is a cross sectional view of an electron beam processor.

The processor schematically illustrated in FIG. 1 is of the second type. The electron beam processor unit used to obtain the results described below was of the second type and more particularly the electron beam processor unit was manufactured by Energy Sciences of Woburn, Mass., and particularly a Model CB 150/15/10 with Energy Sciences' window modifications as described below. This particular electron beam processor operated at up to 175 KV and 10 mA.

Turning now to the drawings and referring first to FIG. 1, an electron beam processor 10 which converts electrical energy into accelerated electrons is illustrated. The electron beam processor 10 includes a filament 12. The filament 12, which may also be referred to as a cathode, is the source of the beam of electrons 14. The filament 12 is housed in a chamber 16 suitable for maintaining a vacuum therein. The chamber 16 also supports an electron transmissible window 18 which may also be referred to as an anode. The chamber 16 as well as other portions of the electron beam processor are surrounded by protective shielding 20 which prevents electrons generated within the electron beam processor from escaping.

Upon the application of sufficient voltage between the filament 12 (cathode) and the window 18 (anode), electrons generated at the filament 12 are accelerated, in vacuum, towards the window 18. The window 18, described in greater detail below, separates the vacuumed environment of the chamber 16 from the ambient pressure conditions in a treating zone 22.

A target material 24, such as a polymer, is exposed to the beam of electrons 14 in the treating zone 22 under ambient pressure conditions. The material 24 may be stationary or moving, such as for example on-line processing of a rolled material. In the case of on-line processing, the material 24 is fed from a roll (not shown) through the treating zone 22 whereupon the material 24 is exposed to the beam of electrons 14. The exposed material 24 may then be collected on another roll (not shown). The collected radiated material 24 may then be fed back through the treating zone 22 for repeated exposures with the same or different compositions suitable for chemical bonding with the exposed material 24.

Whether the material 24 is stationary or moving through the treating zone 22 the material 24 may be contacted by one or more compositions suitable for chemical bonding with the exposed material 24. As previously mentioned, contact between the material 24 and one or more such compositions may occur before the material 24 is exposed to the beam of electrons 14 or after the material 24 is exposed to the beam of electrons 14.

To avoid the disadvantages of conventional electron beam applications described above, the inventors concluded that the electron acceleration voltages (the voltages applied between the filament 12 and the window 18) and the energy of the electron beam 14 contacting the material 24 would have to be modified from those voltages and energies produced by conventional electron beam processors. The inventors further concluded that when the material 24 was positioned from between about 0.5 inches to about 3.5 inches below the window 18 and the treatment zone 22 was continually flooded with nitrogen gas so as to displace oxygen and the material 24 was wet with a modifying material or grafting agent in solution, acceleration voltages of or less than 175 KV and the energy of the electron beam 14 contacting the material 24 of less than 145 KeV would be required.

It was further concluded by the inventors that by contacting the material 24 with electrons having energies below 145 KeV, the electrons contacting the material 24 would exhibit improved stopping powers (absorption), over conventional electron beam applications. Improving the electron beam stopping powers, as will be demonstrated by the examples below, resulted in an improved interaction between the contacting electrons and the material 24.

It was further concluded by the inventors that while conventional electron beam processors which generated electrons with energies in excess of 145 KeV at the point of contact with the material 24 deposited some of their energies in the material 24 to promote chemical bonding, the conventional electron beam processors developed electrons which predominately passed through or perforated the entire thickness of material. It was further concluded by the inventors that electron-perforated materials were weaker than electron-non-perforated materials or materials which stopped or absorbed the electrons at the surface or at some distance beneath the surface, such distance being less than the total thickness of the material.

To achieve these modified acceleration voltages and electron energies, the original window supplied with the Model CB 150/15/10 processor was replaced with a 12 micron sheet of substantially pure aluminum foil 15 cm long by 2.5 cm wide. Construction of the window support and cooling of the window are described in U.S. Pat. No. 3,440,466 which is herein incorporated by reference.

Conductive cooling of the window as well as convective cooling is desirable so that the window foil temperature is maintained below the point at which phase changes leading to destructive failure might occur. To this end, thin support frames of high strength were used. The conductively cooled struts described in the '466 patent were replaced by relatively thin members. Heat reduction was also achieved by conductive transfer in the window foil. These modifications improved window transparency while providing sufficient window foil cooling.

It will be understood by those skilled in the art that generating electron energies at the point of contact with the material 24 is dependent upon, among other things, acceleration voltages, window construction (materials, thicknesses, etc.), distance between the window and the material 24, environment of the chamber 16 and the treating zone 22, and the condition (wet, dry) of the material 24. Therefore to achieve the electron energy ranges at the point of contact with the material 24 of between about 5 KeV to about 110 KeV, the above parameters used in the following examples are but some of many such combinations of parameters suitable for obtaining such energies. Furthermore, as one skilled in the art would appreciate, achieving such energies may also depend upon the configuration, make and model of the particular electron beam processor.

EXPERIMENTAL

Electron Beam Processor. The electron beam processor used in the following examples was the Energy Sciences' Model CB 150/15/10 as described above. In Examples 1–4 the target polymer was positioned a distance of about 1.875 inches from the window. This space, or the treating zone 22, was continually flooded with nitrogen as the target polymer was exposed to electron beam radiation.

Target Polymer. While the particular polymer used was polypropylene it will be understood that other polyolefins may be used. Other suitable polyolefins include but are not limited to polyethylene, polybutylene and copolymers.

In Examples 1–3, the polypropylene material used herein was formed into non-laminate meltblown nonwoven fabrics having a base weight of either 0.7 oz per square yard, having a thickness of about 0.2 mm to about 0.5 mm, or 2.0 oz per square yard, having a thickness of about 1.0 mm to about 2.0 mm. In Example 4, one of the polypropylene materials was a non-laminate spunbond nonwoven fabric. These polypropylene fabrics were produced at Kimberly-Clark's Roswell pilot facility. Prior to radiation, all polypropylene fabric samples were hydrophobic.

Modifying Materials. Modifying materials or grafting agents contacting the polymer were vinyl monomers which included 4-6-fluoro-alpha-phenylstyrene, maleic acid, and 2-Hydroxyethylmethacrylate (HEMA). The 4-6-fluoro-alpha-phenylstyrene was solubilized in Freon-113. The maleic acid and HEMA were solubilized in methanol. Other vinyl monomers suitable for use in the present invention include, but are not limited to, methacylates, alkenes and substituted alkenes.

EXAMPLE 1

The polypropylene samples were cut into 4"×4" squares and soaked for five minutes in a 5%, 10%, or 75% solution of the above described vinyl monomers. After five minutes of soaking, each fabric square was either nipped with a laboratory wringer and then radiated, directly radiated after soaking, or allowed to air dry and then radiated. Unless otherwise indicated, only one side of the samples was exposed to either 175 KV, 125 KV, 100 KV or 75 KV radiation, producing energies at the polypropylene fabric of between about 160 KeV to about 140 KeV, between about 110 KeV to about 85 KeV, between about 75 KeV to about 50 KeV and between about 25 KeV to about 5 KeV, respectively. The treated samples were then washed twice in either Freon-113, or methanol and allowed to air dry.

The gravimetric amount of modifying material chemically bonded to the fabric was determined by weighing the fabric before and after treatment (post wash). In addition, the chemically bonded amount of maleic acid was substantiated by a standard titrimetric procedure using sodium hydroxide (Fisher Scientific) as the titrant.

Tables 1–4 summarize the electron beam effects using 10% maleic acid-methanol solution in combination with 0.7 and 2.0 oz/square yard of meltblown polypropylene polymer fabric (hereinafter the "meltblown fabric"). In each of the Tables 1–4 acceleration voltages were set at 175 KV and 75 KV.

The term "Collective Density" represents the combined density of the meltblown fabric and the modifying material/solvent solution. The term "Unnormalized Wt." represents the total weight of the meltblown fabric (fabric wt. plus the wt. of the modifying material chemically bonded to the fabric) after exposure to electron beam radiation.

The term "Normalization" or "Penetration Factor" is a calculated estimate based upon the depth penetrated by the lower energy electron beam. In essence, the Normalization or Penetration Factor attempts to illustrate the relative efficiencies of the two electron beam energies relative to (i) the depth of penetration in the fabric by the lower energy electron beam and (ii) the weight of the modifying material bonded to the meltblown fabric in the portion of the meltblown fabric penetrated by the lower energy electron beam.

Figure 2:
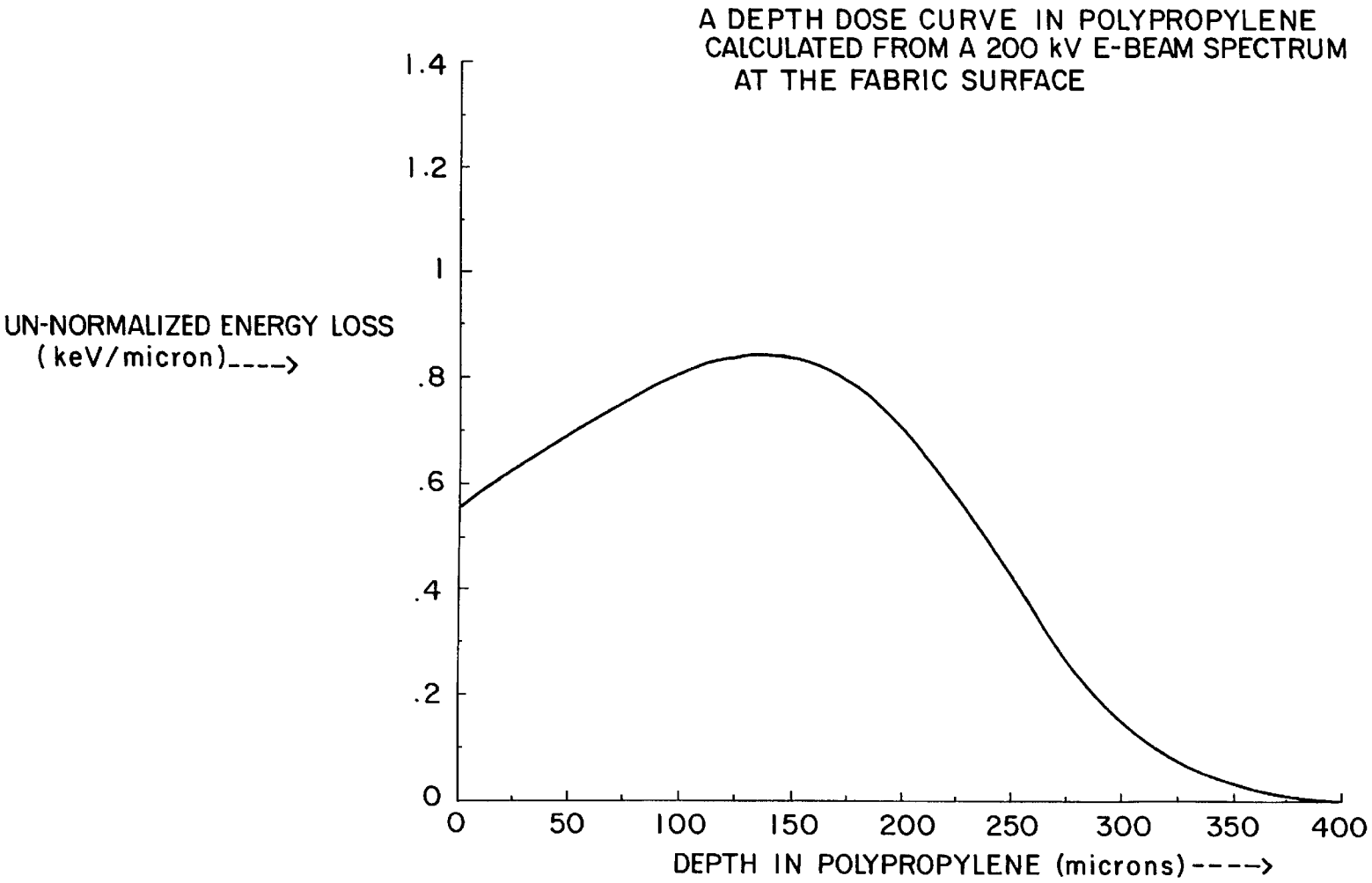
FIG. 2 is a theoretical depth dose curve in a polymer for a 200 KV electron beam.
Figure 3:
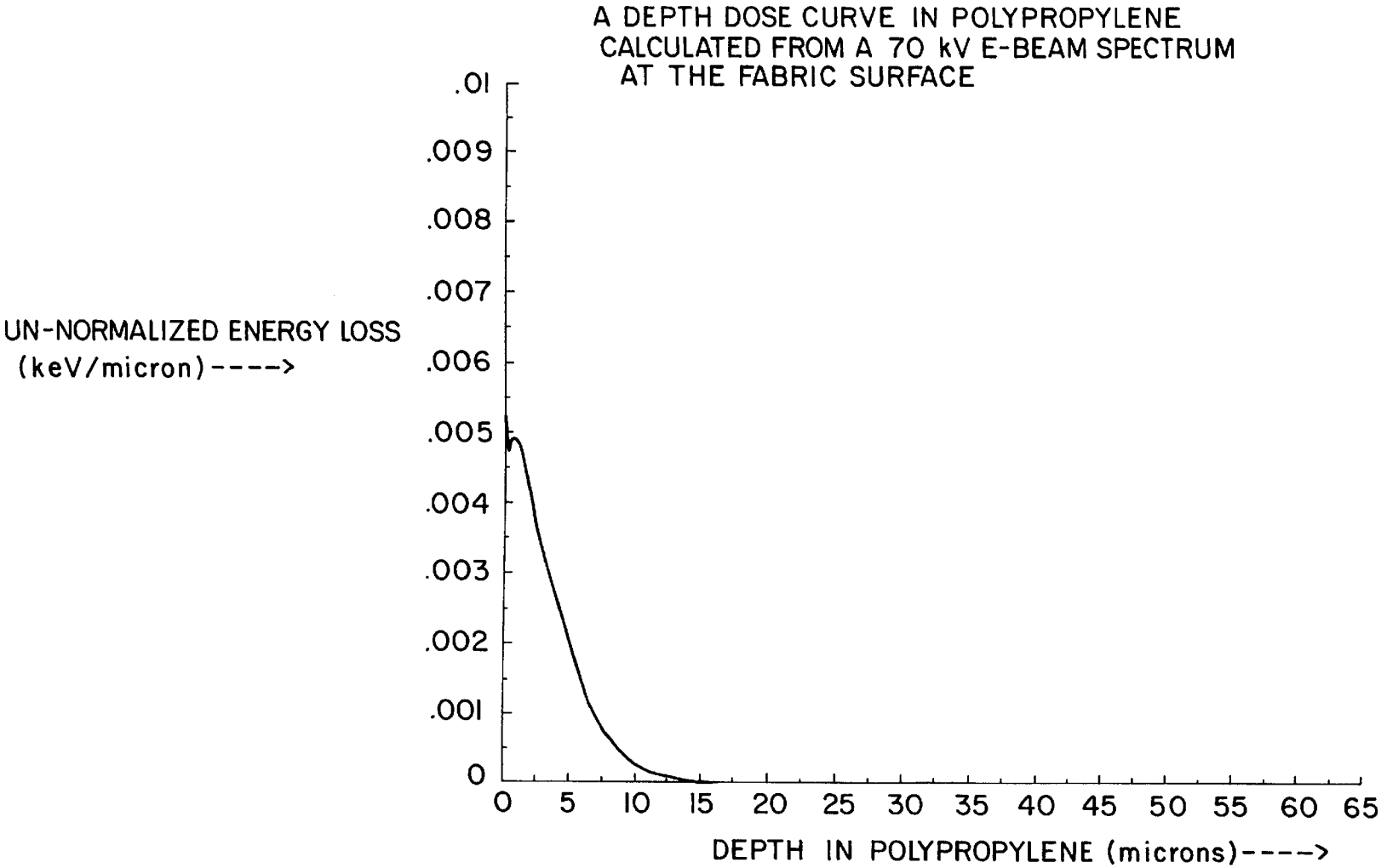
FIG. 3 is a theoretical depth dose curve in a polymer for a 70 KV electron beam.

These estimates were based upon the collective density of each meltblown fabric and mathematically derived depth dose curves for theoretical 200 KV and 70 KV electron beams having theoretical energy levels of 190 KeV to 170 KeV and 20 KeV to 5 KeV, respectively, at the fabric surface. The depth dose curves for the 200 KV and 70 KV are illustrated in FIGS. 2 and 3 respectively.

The depth dose curves were derived by using a Monte Carlo computer modeling code (Sandyl). The code was run on a main frame computer at the Atomic Energy of Canada, Limited, which tracked thousands of numerically simulated electrons. As these electrons were tracked, the energy loss by each electron produced histograms of various energies remaining in the beam at any number of planes from the window foil down to the product and beyond the product. Additionally, an assumption was made that uniform bonding takes place as a function of penetration depth.

For example, referring to Table 1 below, the first run at 175 KV on a meltblown fabric having a collective density of 160 resulted in an unnormalized maleic acid (modifying material) wt. percent bonded of 2.9. The first run at 75 KV on a meltblown fabric having a collective density of 160 resulted in an unnormalized maleic acid wt. percent bonded of 2.1. Based upon the above modeling techniques, it was determined that at the 75 KV setting and respective collective density, the electron energy was absorbed in the top one-tenth of the thickness of the meltblown fabric. Thus, to "normalize" the 175 KV data to the 75 KV data a 1/10 penetration factor was applied to the unnormalized wt. percent bonded at the 175 KV setting.

Due to the Energy Sciences' equipment limitations a 175 KV electron beam was used for all chemical bonding experiments rather than the theoretical 200 KV electron beam that was used for modeling and derivation of the Normalization or Penetration Factors. For the same reason a 75 KV electron beam was experimentally used in the chemical bonding experiments rather than the theoretical 70 KV electron beam. Data used to calculate the values for the 175 and 75 KV data were appropriated from the 200 and 70 KV data without approximation or scaling to the actual 175 or 75 KV settings.

Referring now to Tables 1–4, maleic acid was used as the modifying material. It can be seen in Tables 1–3 that at lower collective densities (60–70 vs. 160–170), the 75 KV electron beam setting produced generally greater unnormalized weights. However, upon normalizing the data, the 75 KV electron beam produced between five to eight fold increases in chemically bonded maleic acid at the normalized depths. In the runs reported in Table 1, the soaked meltblown fabrics were radiated wet. For Tables 2–4, the meltblown fabrics were allowed to air dry before radiation.

TABLE 1

Electron Beam Energy Effects on Maleic Acid Bonding on 0.7 oz/yd$^2$ Fabrics

| Voltage (KV) | Dose (Mrad) | Fabric Weight Neat/Soaked (g)* | Collective Density (g/M$^2$) | Weight Maleic Acid Bonded (g) | Unnormalized Wt. % Bonded | Normalization or Penetration Factor (Estimate) | Normalized Wt. % Bonded |
|---|---|---|---|---|---|---|---|
| 175 | 3 | 0.24/1.6 | 160 | 0.007 | 2.9 | 1/10 | 0.29 |
| 175 | 6 | 0.25/1.6 | 160 | 0.007 | 2.8 | 1/10 | 0.28 |
| 175 | 10 | 0.23/1.6 | 160 | 0.009 | 3.9 | 1/10 | 0.39 |
| | | | | | Ave. 3.2 | | Ave. 0.32 |
| 75 | 3 | 0.24/1.6 | 160 | 0.005 | 2.1 | 1 | 2.1 |
| 75 | 6 | 0.24/1.7 | 170 | 0.005 | 2.1 | 1 | 2.1 |
| 75 | 10 | 0.23/1.6 | 160 | 0.007 | 3.0 | 1 | 3.0 |
| | | | | | Ave. 2.4 | | Ave. 2.4 |

*Soaked materials were not allowed to air dry.

TABLE 2

Electron Beam Energy Effects on Maleic Acid Bonding on 0.7 oz/yd$^2$ Fabrics

| Voltage (KV) | Dose (Mrad) | Fabric Weight Neat/Soaked (g)* | Collective Density (g/m$^2$) | Weight Maleic Acid Bonded (g) | Unnormalized Wt. % Bonded | Normalization or Penetration Factor (Estimate) | Normalized Wt. % Bonded |
|---|---|---|---|---|---|---|---|
| 175 | 3 | 0.23/0.64 | 64 | 0.007 | 3.0 | 1/5 | 0.60 |
| 175 | 6 | 0.31/0.71 | 71 | 0.008 | 2.6 | 1/5 | 0.52 |
| 175 | 10 | 0.26/0.65 | 65 | 0.007 | 2.7 | 1/5 | 0.54 |
| | | | | | Ave. 2.8 | | Ave. 0.55 |
| 75 | 3 | 0.26/0.72 | 72 | 0.007 | 2.7 | 1 | 2.7 |

TABLE 2-continued

| Voltage (KV) | Dose (Mrad) | Fabric Weight Neat/Soaked (g)* | Collective Density ($g/m^2$) | Weight Maleic Acid Bonded (g) | Unnormalized Wt. % Bonded | Normalization or Penetration Factor (Estimate) | Normalized Wt. % Bonded |
|---|---|---|---|---|---|---|---|
| | | Electron Beam Energy Effects on Maleic Acid Bonding on 0.7 $oz/yd^2$ Fabrics | | | | | |
| 75 | 6 | 0.23/0.69 | 69 | 0.008 | 3.5 | 1 | 3.5 |
| 75 | 10 | 0.24/0.68 | 68 | 0.008 | 3.3 | 1 | 3.2 |
| | | | | | Ave. 3.2 | | Ave. 3.2 |

*Soaked materials were allowed to air dry for five minutes.

TABLE 3

| Voltage (KV) | Dose (Mrad) | Fabric Weight Neat/Soaked (g)* | Collective Density ($g/M^2$) | Weight Maleic Acid Bonded (g) | Unnormalized Wt. % Bonded | Normalization or Penetration Factor (Estimate) | Normalized Wt. % Bonded |
|---|---|---|---|---|---|---|---|
| | | Electron Beam Energy Effects on Maleic Acid Bonding on 0.7 $oz/yd^2$ Fabrics | | | | | |
| 175 | 3 | 0.21/0.62 | 62 | 0.007 | 3.3 | 1/5 | 0.66 |
| 175 | 6 | 0.23/0.71 | 71 | 0.007 | 3.0 | 1/5 | 0.60 |
| 175 | 10 | 0.22/0.68 | 68 | 0.008 | 3.6 | 1/5 | 0.72 |
| | | | | | Ave. 3.3 | | Ave. 0.66 |
| 75 | 3 | 0.23/0.69 | 69 | 0.007 | 3.0 | 1 | 3.0 |
| 75 | 6 | 0.21/0.66 | 66 | 0.007 | 3.3 | 1 | 3.3 |
| 75 | 10 | 0.22/0.68 | 68 | 0.008 | 3.6 | 1 | 3.6 |
| | | | | | Ave. 3.3 | | Ave. 3.3 |

*Soaked materials were allowed to air dry for five minutes.

TABLE 4

| Voltage (KV) | Dose (Mrad) | Fabric Weight Neat/Soaked (g)* | Collective Density ($g/M^2$) | Weight Maleic Acid Bonded (g) | Unnormalized Wt. % Bonded | Normalization or Penetration Factor (Estimate) | Normalized Wt. % Bonded |
|---|---|---|---|---|---|---|---|
| | | Electron Beam Energy Effects on Maleic Acid Bonding on 2 $oz/yd^2$ Fabrics | | | | | |
| 175 | 3 | 0.69/3.1 | 310 | 0.017 | 2.5 | 1/20 | 0.13 |
| 175 | 6 | 0.73/2.9 | 290 | 0.021 | 2.9 | 1/20 | 0.15 |
| 175 | 10 | 0.75/3.0 | 300 | 0.018 | 2.4 | 1/20 | 0.12 |
| | | | | | Ave. 2.6 | | Ave. 0.13 |
| 75 | 3 | 0.73/3.1 | 310 | 0.026 | 3.6 | 1 | 3.6 |
| 75 | 6 | 0.71/3.1 | 310 | 0.025 | 3.5 | 1 | 3.5 |
| 75 | 10 | 0.68/3.0 | 300 | 0.023 | 3.4 | 1 | 3.4 |
| | | | | | Ave. 3.5 | | Ave. 3.5 |

*Soaked materials were allowed to air dry for five minutes.

Referring now to Table 4, meltblown fabrics having weights of 2 oz per square yard were soaked with maleic acid/methanol solution. The collective densities of all meltblown fabrics ranged from 290 to 310. While the averaged unnormalized data indicates a modestly greater percent weight of maleic acid chemically bonded to the meltblown fabric at the 75 KV setting, the averaged normalized data indicates around a twenty seven fold increase in efficiency at the 75 KV setting.

Tables 5 and 7 present the results for chemical bonding of HEMA and 4-fluoro-alpha-phenylstyrene, respectively, to the fabric samples. The meltblown fabrics reported in both Table 5 and 7 were wet with modifying material at the time of electron beam exposure. As noted in Table 5, the fabrics were soaked then nipped to the reported weights.

As is illustrated in Table 5, the normalized data shows a greater than three fold increase in chemical bonding efficiency at the 75 KV setting as compared to the 175 KV setting. As chemical bonding efficiency is herein determined by weight, it should not be overlooked that in the case of HEMA, homopolymerization, which was not accounted for in these results, may contribute in some instances to weight gain.

The normalized results in Table 7 indicates a greater than four fold increase in chemical bonding efficiency at the 75 KV setting as compared to the 175 KV setting.

TABLE 5

Electron Beam Energy Effects on HEMA**
Bonding on 2 oz/yd$^2$ Fabrics

| Voltage (KV) | Dose (Mrad) | Fabric Weight Neat/Soaked (g)* | Collective Density (g/M$^2$) | Weight HEMA Acid Bonded (g) | Unnormalized Wt. % Bonded | Normalization Factor (Estimate) | Normalized Wt. % Bonded |
|---|---|---|---|---|---|---|---|
| 175 | 5 | 0.74/2.2 | 210 | 0.031 | 4.2 | 1/4 | 1.1 |
| 175 | 10 | 0.74/2.2 | 220 | 0.040 | 5.4 | 1/4 | 1.4 |
| | | | | | Ave. 4.8 | | Ave. 1.3 |
| 75 | 5 | 0.73/2.1 | 210 | 0.029 | 4.0 | 1 | 4.0 |
| 75 | 10 | 0.74/2.2 | 220 | 0.037 | 5.0 | 1 | 5.0 |
| | | | | | Ave. 4.5 | | Ave. 4.5 |

*Soaked in 75% HEMA, 25% MeOH, wt/wt and then nipped to the above weight.
**HEMA = 2-hydroxyethylmethacrylate.

TABLE 6

Electron Beam Energy Effects on HEMA
Bonding on 2 oz/yd$^2$ Fabrics

| Voltage (KV) | Dose (Mrad) | Normalized Wt % Bonded (Estimate) | % Fabric (Top) Receiving Beam Energy (Depth) | Wettability |
|---|---|---|---|---|
| 175 | 5 | 4.2 | 100 | Wet on Top and Bottom Surface and Penetration into Bulk |
| 175 | 10 | 5.4 | 100 | Wet on Top and Bottom Surface and Penetration into Bulk |
| 75 | 5 | 12 | 25 | Wet on Top Surface - No Penetration into Bulk |
| 75 | 10 | 15 | 25 | Wet on Top Surface - No Penetration into Bulk |

TABLE 7

Electron Beam Energy Effects on 4-Fluoro-alpha-phenylstyrene
Bonding on 2 oz/yd$^2$ Fabrics

| Voltage (KV) | Dose (Mrad) | Fabric Weight Neat/Soaked (g)* | Collective Density (g/M$^2$) | Weight Fluorophenyl-styrene Bonded (g) | Unnormalized Wt. % Bonded | Normalization Factor (Estimate) | Normalized Wt. % Bonded |
|---|---|---|---|---|---|---|---|
| 175 | 5 | 0.71/3.12 | 312 | 0.012 | 1.7 | 1/5 | 0.34 |
| 175 | 15 | 0.72/3.25 | 325 | 0.018 | 2.5 | 1/5 | 0.50 |
| 75 | 5 | 0.74/3.41 | 341 | 0.011 | 1.5 | 1 | 1.5 |
| 75 | 10 | 0.73/3.24 | 324 | 0.017 | 2.3 | 1 | 2.3 |

Table 6 illustrates the water wetting performance of the HEMA treated materials at both the 175 KV and 75 KV settings. For the 175 KV setting runs, the front and back surfaces of the meltblown fabric were wet with water with penetration into the bulk of the fabric between the front and back surfaces. For the 75 KV setting runs, only the front surface of the meltblown fabric was wet with little or no water penetration into the fabric bulk.

The data in Table 6, as well as the data contained in Tables 8–11, clearly demonstrates the ability to control chemical bonding by radiating at selectively reduced energy levels. This data further supports the theoretical calculations and theories for illustrating chemical bonding efficiencies by "normalizing" the data as described above.

TABLE 8

SURFACE BONDING COMPARISON OF HIGH VERSUS LOW BEAM

| HEMA Bonding | ESCA Analysis (Atom %) C | O |
|---|---|---|
| Low Energy (75 KV, 5 Mrad) | | |
| Top Side | 75 | 24 |
| Bottom Side | 98 | 2 |
| High Energy (175 KV, 5 Mrad) | | |
| Top Side | 92 | 8 |
| Bottom Side | 93 | 7 |

0.7 os/square yard Spunbond Fabric soaked in 75% HEMA/Methanol solution to give a collective density of 220 g/m$^2$. After exposure the fabrics were washed with water and then dried.

TABLE 9

| SURFACE BONDING COMPARISON OF HIGH VERSUS LOW BEAM | | | |
|---|---|---|---|
| | ESCA Analysis (Atom %) | | |
| 4-Fluoro—Phenyl—Styrene Bonding | C | O | F |
| Low Energy (75 KV, 5 Mrad) | | | |
| Top Side | 58 | 4 | 36 |
| Bottom Side | 98 | 2 | — |
| High Energy (175 KV, 5 Mrad) | | | |
| Top Side | 74 | 2 | 24 |
| Bottom Side | 75 | 2 | 23 |

0.7 os/square yard Spunbond Fabric soaked in 5% 4-Fluoro—Phenyl—Styrene/Freon-113 solution (collective density 230 g/m$^2$. After exposure to E-Beam, the fabrics were washed with Freon-113 and dried.

As has been demonstrated by the above Tables, one advantage of chemical bonding by exposing a polymer to selective energies is the ability to control the depth of penetration of the radiant energy into the fabric. By controlling the depth of penetration, control of the formation of free radicals in the fabric as well as the depth of chemical bonding in the fabric between the modifying material and the fabric at such depths are now achievable.

Table 8reports ESCA analysis for HEMA-bonded meltblown fabrics at the 75 KV and 175 KV settings. Table 9 reports ESCA analysis for 4-fluoro-phenyl-styrene-bonded meltblown fabrics at the 75 KV and 175 KV settings.

Referring now to Table 8, at the 75 KV setting, HEMA was present only on the top side, or side exposed to electron beam radiation. The 2% of oxygen atoms detected on the bottom side was concluded to be merely background and not from the presence of chemically bonded HEMA.

Surface analysis of the treated fabrics using ESCA reported in Table 9 confirms that hydrophilic 4-fluoro-phenyl-styrene was only present on the surface of the fabric exposed to electron beam at the 75 KV settings.

EXAMPLE 2

Experimentation demonstrating the formation of a concentration gradient is reported in Table 10. In preparation for these ESCA analysis a 0.7 oz/square yard meltblown fabric was soaked in a 75% HEMA/methanol solution (220 g/square meter collective density) and exposed to a 125 KV electron beam (10 Mrad). The surface analysis data for the "exposed" and "non-exposed" fabric surfaces are presented below.

TABLE 10

| | ESCA Analysis (Atom %) | |
|---|---|---|
| | C | O |
| Top Side of Fabric (Exposed) | 75 | 25 |
| Bottom Side of Fabric (Non-Exposed) | 90 | 10 |

This data clearly shows a chemically bonded HEMA concentration gradient in the meltblown fabric. The top side of the fabric shows a larger concentration of HEMA than the bottom side. Additionally, further evidence supporting the formation of a concentration gradient is that while the top side of the fabric rapidly wetted with water the bottom side of the material only wetted slowly.

EXAMPLE 3

A further treatment configuration tested included coating one of the surfaces of the meltblown fabric with a first modifying material which chemically bonded thereto upon exposure of that surface to electron beam radiation. The other surface was coated with a second modifying material which chemically bonded thereto upon exposure of that surface to electron beam radiation. This was accomplished by the following procedure.

A 0.7 oz/square yard material was first soaked in 75% HEMA/methanol (225 g/square meter collective density). One of the surfaces of the material was exposed to an electron beam at the 75 KV setting. The once radiated material was then washed and dried and re-soaked in a 5% 4-fluoro-alpha-styrene/Freon-113 solution (250 g/square meter collective density). The non-radiated surface of the material was then exposed to the electron beam at the 75 KV setting. Table 11 reports the surface analysis data.

TABLE 11

| | ESCA Analysis (Atom %) | | |
|---|---|---|---|
| | C | O | F |
| Top Side of Fabric (HEMA) | 75 | 24 | — |
| Bottom Side of Fabric (4-Fluoro-alpha-phenylstyrene) | 98 | 4 | 36 |

The top side of the treated fabric was water wettable and the bottom side was hydrophobic and alcohol repellant (n-propanol).

Based upon the above data, it has been shown that the surfaces of a polymer, such as a polypropylene nonwoven fabric having a first and second surface separated by a interior thickness, can be selectively modified by chemical bonding induced by selective radiant energies, and particularly by selective electron beam radiant energies. By controlling the spectrum of the radiant energies contacting the polymer and depth of penetration by the radiation into the polymer and thus the depth of free radical formation in the polymer, together with selective chemistry, and particularly selective vinyl chemistry, it is possible not only to chemically bond at a surface and/or to selective levels beneath said surface, thus forming a concentration gradient, but it is further possible to chemically bond the same or different chemicals to different surfaces, such as opposing surfaces, of the polymer. Additionally, it is now possible via radiation, and particularly electron beam radiation, to introduce a number of opposing and/or complimentary surface properties, such as hydrophilic and hydrophobic surface properties, into the same polymer material.

It will be further appreciated by those skilled in the art that while the particular physical properties of the nonwoven samples tested above required radiation at the above reported radiant energy levels to achieve these results, modifying materials and polymers formed from different compositions and/or having different physical properties, such as density and collective density, as well as polymers having different textures, such as nonwoven laminates, films, film laminates, nonwoven/film laminates and microporous films may require radiant energy levels which vary from those reported here in order to achieve selective depth penetration and corresponding selective chemical bonding.

EXAMPLE 4

To determine the effect of electron beam radiation at various settings on the polypropylene materials, two non-laminate nonwoven fabrics formed from polypropylene were exposed to electron beam radiation. Once radiated, the fiber strengths of the samples were analyzed using the grab tensile test.

One of the polypropylene fabrics included 2.0 oz/square yard fabric samples of a spunbond non-laminate nonwoven polypropylene which were radiated at the 175 KV and 100 KV settings. Table 12 reports the grab tensile strength analysis of the radiated spunbond fabrics. The other polypropylene fabric included samples of a meltblown non-laminate nonwoven polypropylene which were also radiated at the 175 KV and 100 KV settings. Table 13 reports the grab tensile strength analysis of the radiated meltblown fabrics.

TABLE 12

| | | PEAK LOAD (lb) | |
|---|---|---|---|
| Voltage (KV) | Dose (Mrad) | MD | CD |
| 175 | 10 | 33.1 +/− 2.1 | 23.1 +/− 0.5 |
| 100 | 10 | 39.4 +/− 3.2 | 25.7 +/− 3.0 |
| 175 | 5 | 34.6 +/− 1.6 | 21.3 +/− 1.4 |
| 100 | 5 | 43.5 +/− 5.0 | 25.8 +/− 1.6 |
| Control | — | 44.2 +/− 1.9 | 26.1 +/− 1.4 |

MD - Machine Direction CD - Cross Direction

TABLE 13

| Voltage (KV) | Dose (Mrad) | Breaking Point (kg) |
|---|---|---|
| 175 | 10 | 3.5 +/− 0.1 |
| 100 | 10 | 3.0 +/− 0.1 |
| 175 | 5 | 3.8 +/− 0.1 |
| 100 | 5 | 3.2 +/− 0.1 |
| Control | — | 3.8 +/− 0.1 |

10 Polypropylene Meltblown Fabrics
6" × 2" Samples at Each Dose

From the data described in Table 12 it is clear that exposure at the lower setting produces little or no effect on the nonwoven spunbond fabric tensile. In contrast, exposure at the higher setting considerably weakens the fabric. It is thought that this weakening occurs at the higher settings as a result of the electrons passing through the entire thickness of the fabric.

It is thought that the highly ionizing energy of the electrons at the higher setting results in radical formation on both the fabric surfaces and in the bulk, leading to degradation of the fabric. In contrast to the higher settings, the electrons produced at the lower settings having lower ionizing energy are stopped or absorbed at the surface or at some distance in to the bulk which is less than the total thickness of the fabric. Therefore, it is thought that at the 100 KV setting, there remains portions of the fabric bulk or thickness which are not contacted by electrons.

The grab tensile test results reported in Table 13 appear at first to suggest that greater tensile strength loss occurs at the lower electron beam setting. However, unlike spunbond fabrics fibers, meltblown fabric fibers are considerably shorter. As such, unbonded meltblown fabrics comprise short entangled fibers. The grab tensile analysis of the meltblown fabrics gives the energy required to untangle these relatively short fibers and not the energy required to break the fibers. Additionally, grab tensile deviation errors for meltblown fabrics are typically 20% to 30% which would essentially make the reported breaking point data for each sample the same.

In view of the above data and experimentation, the inventors have clearly established that by exposing a polymer to radiation at selective energy levels, chemical bonding, and particularly depth of chemical bonding within the polymer, between a polymer and a first modifying material and/or second modifying material can be selectively controlled with minimal if any loss of polymer strength.

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto.

We claim:

1. A process for selectively chemically modifying a shaped polymeric material having a first surface and a second surface separated by a thickness, the process comprising:

contacting the shaped polymeric material with a first unsaturated modifying compound having a first substituent capable of altering the surface characteristics of the shaped polymeric material;

exposing the shaped polymeric material under ambient pressure conditions to from about 5 KeV to about 85 KeV of ionizing radiation from an ionizing electron beam radiation source operating at an energy potential of from about 75 KeV to about 125 KeV to selectively chemically bond the first modifying compound to the first surface of the shaped polymeric material, wherein the first surface is facing the ionizing electron beam radiation source;

washing the shaped polymeric material to remove first modifying compound which was not chemically bonded;

contacting the shaped polymeric material with a second unsaturated modifying compound having a second substituent capable of altering the surface characteristics of the shaped polymeric material; and exposing the shaped polymeric material under ambient pressure conditions to from about 5 KeV to about 85 KeV of ionizing radiation from an ionizing electron beam radiation source operating at an energy potential of from about 75 KeV to about 125 KeV to selectively chemically bond the second modifying compound to the second surface of the shaped polymeric material, wherein the second surface is facing the ionizing electron beam radiation source.

2. The process of claim 1 which further comprises:

washing the shaped polymeric material to remove second modifying compound which was not chemically bonded.

3. The process of claim 1, in which the shaped polymeric material is a fibrous web.

4. The process of claim 1, in which the shaped polymeric material is a nonwoven web.

5. The process of claim 1, in which the shaped polymeric material is a shaped polyolefin material.

6. The process of claim 5, in which the polyolefin is polypropylene or polyethylene.

7. The process of claim 1, in which the second substituent is fluorine, a hydroxy group, or a carboxy group.

8. The process of claim 1, in which the first and second substituents are the same.

9. The process of claim 8, in which the first and second substituents are fluorine, a hydroxy group, or a carboxy group.

10. The process of claim 1, in which the first and second substituents are different.

11. The process of claim 10, in which each of the first and second substituents independently is fluorine, a hydroxy group, or a carboxy group.

* * * * *